US005544908A

United States Patent [19]

Fezio

[11] Patent Number: 5,544,908

[45] Date of Patent: Aug. 13, 1996

[54] THERMOPLASTIC COMPOSITE SKI AND METHOD OF MANUFACTURE

[75] Inventor: Louis J. Fezio, Vashon, Wash.

[73] Assignee: K-2 Corporation, Vashon, Wash.

[21] Appl. No.: 239,221

[22] Filed: May 6, 1994

[51] Int. Cl.[6] ..... A63C 5/14

[52] U.S. Cl. ..... 280/610; 264/257

[58] Field of Search ..... 280/610, 602; 264/46.4, 46.6, 46.7, 257

[56] References Cited

U.S. PATENT DOCUMENTS

| | | | |
|---|---|---|---|
| 3,867,221 | 2/1975 | Chant | 156/77 |
| 4,115,506 | 9/1978 | Shima | 264/250 |
| 4,118,051 | 10/1978 | Shima | 280/610 |
| 4,130,614 | 12/1978 | Saidla | 264/46.4 |
| 4,159,294 | 6/1979 | Oishi et al. | 264/45.3 |
| 4,222,808 | 9/1980 | Hale et al. | 156/245 |
| 4,233,098 | 11/1980 | Urbain | 156/242 |
| 4,444,832 | 4/1984 | Mazzola et al. | 428/290 |
| 4,681,725 | 7/1987 | Maruyama | 264/46.5 |
| 4,902,548 | 2/1990 | Cholat-Serpoud et al. | 280/610 |
| 4,993,740 | 2/1991 | Recher et al. | 280/610 |
| 4,999,224 | 3/1991 | Bocquet et al. | 427/356 |
| 5,006,288 | 4/1991 | Rhodes, Jr. et al. | 264/46.6 |
| 5,057,170 | 10/1991 | Legrand et al. | 156/73.5 |
| 5,171,509 | 12/1992 | Le Masson et al. | 280/610 |
| 5,173,226 | 12/1992 | Cazaillon et al. | 264/46.6 |
| 5,183,618 | 2/1993 | Pascal et al. | 264/257 |
| 5,230,844 | 7/1993 | Macaire et al. | 264/46.7 |
| 5,273,696 | 12/1993 | Cazaillon et al. | 264/45.2 |
| 5,288,097 | 2/1994 | Pascal et al. | 280/610 |
| 5,288,442 | 2/1994 | Bauvois | 264/45.2 |
| 5,294,139 | 3/1994 | Cazaillon et al. | 280/610 |

FOREIGN PATENT DOCUMENTS

| | | | |
|---|---|---|---|
| 558009 | 9/1993 | European Pat. Off. | 280/610 |
| 0456965A1 | 11/1991 | France | 5/12 |
| 2687925 | 9/1993 | France | 5/12 |

*Primary Examiner*—Brian L. Johnson

*Attorney, Agent, or Firm*—Christensen O'Connor Johnson & Kindness PLLC

[57] ABSTRACT

A runner for gliding over snow that includes a thermoplastic composite structural layer. The runner is preferably a snow ski. The snow ski includes an outer layer, a core, a structural layer, a base, and edges. The core has upper and lower surfaces and two lateral sides. The structural layer is joined to the outer layer and is made of a thermoplastic material having multidirectional, high-modulus reinforcing fibers embedded within the thermoplastic. The thermoplastic material is disposed across the upper surface and along the lateral sides of the core and joins the outer layer to the core. The base has a bottom sliding surface for contact with the snow, lateral sides, and a top surface. The top surface of the base is joined to the core and includes a resin-impregnated fiber material for structural rigidity. The edges extend longitudinally along the lateral sides of the base. The disclosure also includes a method of manufacturing the ski by joining a thermoplastic composite layer to an outer layer, molding the joined layers into a top cap, placing the top cap and a base within a jig, and injecting foam between the base and top cap.

17 Claims, 3 Drawing Sheets

THERMOPLASTIC COMPOSITE SKI AND METHOD OF MANUFACTURE

FIELD OF THE INVENTION

The present invention relates generally to skis and other devices for traveling over snow and, more particularly, to skis and ski construction methods using thermoplastic materials.

BACKGROUND OF THE INVENTION

Skis and snowboards typically include a core, a structural layer surrounding the core, a base, and an outer layer covering the top or the top and sides of the ski. By far the most common structural layer is fiberglass impregnated with a thermosetting resin, notwithstanding that the thermoset/fiberglass layer is difficult to work with and requires substantial curing periods during the production process. Other composites using thermosetting resins are equally difficult and time-consuming to use. For example, forming an injection-molded ski with a thermoset is commonly carried out by laying the uncured preimpregnated fiberglass (or other composite) on a plastic top sheet and placing both in a heated die to form an outer shell. The die shapes the shell with heat and pressure. An average of ten minutes is required to cure the fiberglass. Once the outer shell is cured, the lower surface of the fiberglass is specially prepared for bonding by abrading, cleaning, applying a primer, or other method. The shell is then placed in a jig with a base, the base having edges and a fiberglass/thermoset resin structural layer. The foam core is then injected between the base and the top and joins the two together by bonding to the roughened fiberglass surface. The bond occurs by the foam penetrating into the roughened surface of the fiberglass and curing.

Before the outer shell and base are placed in the jig, the surfaces of the fiberglass that are to come in contact with the foam to join the top and base to the foam core must be roughened so that the mechanical bond between these parts is strong enough to avoid premature delamination between them. Significant chemical bonding does not take place between the cured fiberglass layers and the foam core. Thus, even with careful surface sanding to increase the mechanical bond strength, some degree of delamination, and thus degradation of the flex characteristics or structure of the ski, may occur over time.

The steps of laying up the wet fiberglass/thermosetting resin composite, waiting for it to cure, and preparing the surfaces to bond well with the foam are labor intensive, time consuming, and imprecise. Thus, the cost of the ski is high even though relatively low-cost materials are used.

Skis with a torsion box construction also include top layers or outer shells that must be bonded to the top and, possibly, sides of the torsion box. A torsion box is a load-beating shell that completely surrounds the core of the ski. The torsion box is constructed of a high modulus fiber sock (fiberglass, carbon, KEVLAR (trademark), or ceramic) impregnated with a thermosetting resin material. The core is typically constructed of wood, such as fir or spruce, or may be a polyethylene foam. The current wrapping and curing processes using a thermosetting resin with the fiber sock are also very time-consuming and difficult.

Skis with tops that include a top layer such as that described above, or any with an outer shell that extends not only over the top surface of the ski, but also down the sides from edge to edge have recently become very popular. However, one problem with such shells is the lack of thermal stability of the acrylic or urethane material of which they are made. These materials lack stability and rigidity to the point that many blemished skis are produced due to the shrinkage that occurs when the shell cools after being placed on the ski. As the shell cools it contracts and, from time to time, dimples, bumps, or other discontinuities occur.

Because of the above-described drawbacks of the present methods and construction of skis, the present invention was developed. Use of the method and construction of the present invention will reduce manufacturing times and errors inherent in making skis with foam-injected cores, skis with other cores, and skis with edge-to-edge outer shells.

SUMMARY OF THE INVENTION

A method of manufacturing a runner for gliding over snow is provided. The runner is preferably a ski, but may alternatively be a snowboard or other snow-gliding device. The body of the ski comprises a core covered with a shell having an outer layer. The method includes the steps of providing a thermoplastic composite layer comprised of fibers disposed within a thermoplastic resin, joining the thermoplastic composite layer to the outer layer, heating the two layers, and molding the shell, including the outer layer and the thermoplastic composite layer, into a top cap shape. The shell is heated by placing it in proximity to infrared lamps. The step of molding the shell is accomplished with forming dies. The dies absorb the heat from the step of heating the shell while pressing the shell into a top cap shape. Preferably, the method further includes the steps of providing a base, inserting a core between the base and the shell, and joining the base and the shell together around the core. The base has a bottom surface, a top surface, and lateral sides. The lateral sides have edges extending along the length of the base.

In the preferred embodiment of the invention, the steps of inserting a core and joining a base to the shell include the steps of positioning the base adjacent the shell and injecting foam between the base and the shell. The base is positioned in a jig adjacent the molded shell. The thermoplastic composite layer of the shell faces the base. The shell and the base form the outer shape of the ski. The foam is injected between the base and the shell to form the core and join the base to the shell.

In an alternate embodiment of the invention a further step is included. A composite reinforcing layer is joined to the top or inner surface of the base before the base is positioned adjacent the shell. The reinforcing layer is preferably constructed of a thermoplastic composite. The thermoplastic composite is joined to the top or inner surface of the base by applying heat to the thermoplastic composite while pressing it to the top surface of the base.

Likewise, in the preferred form of the invention, the step of joining the thermoplastic composite layer to the outer layer is carried out through application of heat and pressure to the layers.

As another aspect of the preferred embodiment of the invention, the thermoplastic composite layer includes fibers extending within the thermoplastic resin in a plurality of directions. Preferably, these fibers are woven together. An alternate method of the present invention includes the steps of providing a core and torsion box around the core instead of using a foam injection construction. A base is provided having a bottom surface, a top surface, and lateral sides. The lateral sides have edges. The core and torsion box are inserted between the base and the shell. In one form of the alternate method the torsion box is constructed of a thermoplastic composite material.

The preferred embodiment of the present invention comprises a snow ski constructed generally according to the method discussed above. Alternatively, a snowboard or other runner for gliding over snow may be provided according to the present invention. The snow ski includes an outer layer, a core, a structural layer, a base, and metal edges. The core has upper and lower surfaces and two lateral sides. The structural layer is joined to the outer layer. The structural layer is constructed of a thermoplastic material having multidirectional, high-modulus reinforcing fibers embedded within the thermoplastic material. The thermoplastic material is disposed across the upper surface and along the lateral sides of the core and joins the outer layer to the core. The base has a bottom sliding surface for contact with the snow and a top surface joined to the core with a resin-impregnated fiber material. The edges extend longitudinally along the lateral sides of the base. Preferably, the core is constructed of an injection-molded foam.

In an alternate embodiment of the runner, the upper structural layer and the bottom structural layer are integrally formed of the thermoplastic material wrapped around the core.

In another alternate embodiment of the runner of the present invention, an outer layer covers the upper surface and lateral sides of the structural layer. A stability layer is disposed between the top layer and the structural layer and provides rigidity and stability to the outer layer. The stability layer includes a thermoplastic composite material constructed of high-modulus fibers embedded in a thermoplastic resin.

The advantages to the embodiments of the invention discussed above are numerous. Surface sanding to prepare for bonding of the thermoplastic composite structural material is not necessary for a good bond to an injection foam core. The injection foam core bonds chemically to the thermoplastic composite material instead of by means of the weaker principally mechanical bond present with a thermosetting resin material. The thermoplastic composite material is also easier to join to the outer layer than other structural layers used in the past. Thus, a cap ski configuration can reasonably be constructed with a reduction in manufacturing time since curing of a thermoset is not necessary. Reduction in manufacturing errors may also be realized since the time-consuming hand layup of a wet fiberglass or other composite material is eliminated. The use of a stability layer under the outer layer in the alternate embodiment of the invention decreases the instability of the typical urethane outer layer such that dimples and other discontinuities are eliminated.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

Figures 1, 2:
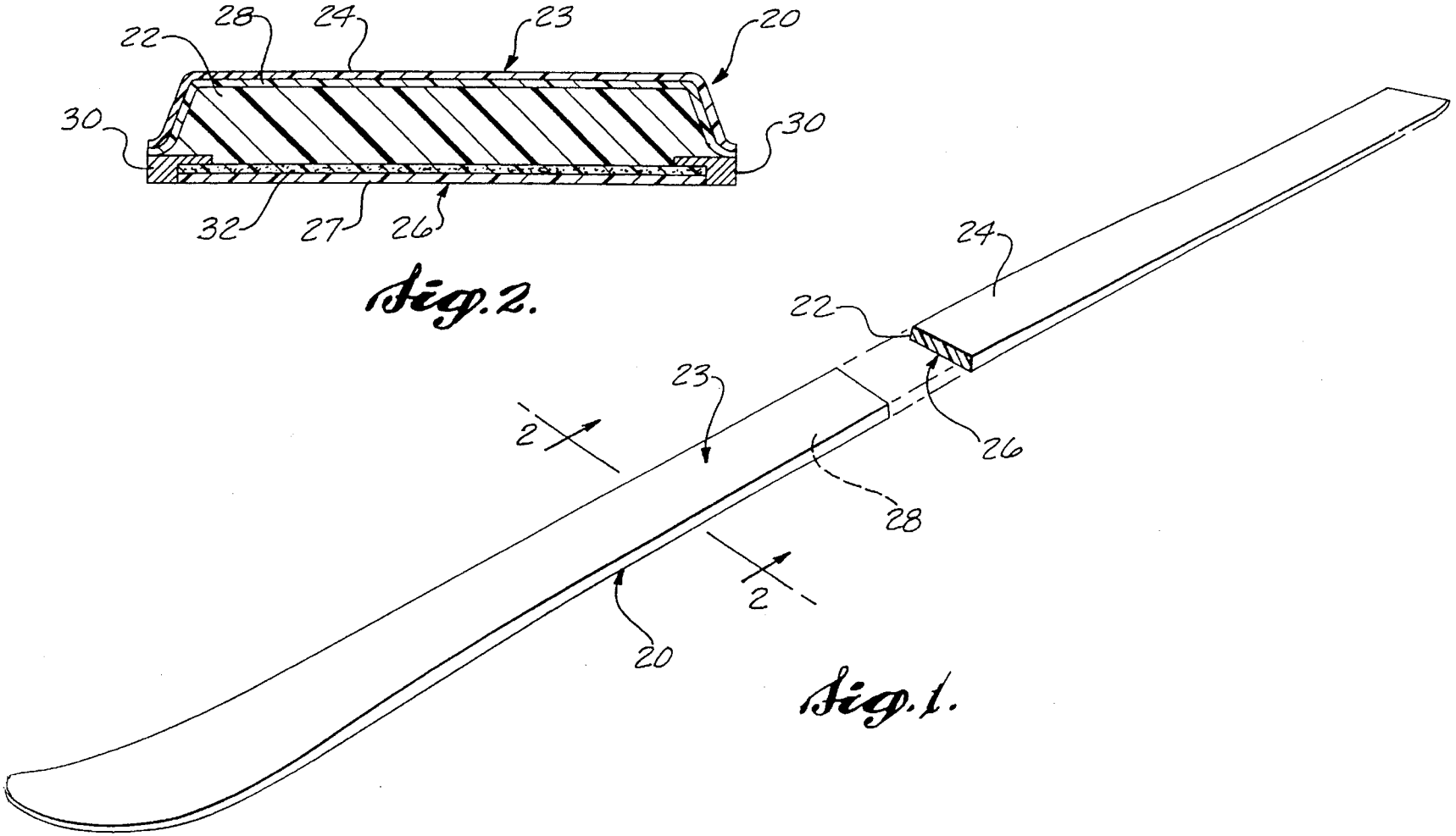
FIG. 1 is a perspective view of a ski according to the present invention.
FIG. 2 is a cross-sectional elevational view showing the preferred embodiment of the ski construction.

Referring to FIGS. 1 and 2, the preferred embodiment of the runner of the present invention will first be described. The runner is preferably a ski and will be described as such in this description of the preferred embodiment. The ski includes a core 22, a shell 23, and a base 26. Shell 23 includes an outer layer 24 and a thermoplastic composite layer 28 beneath outer layer 24. Core 22 runs substantially the length of the ski and is preferably constructed of a foam material such as a polyethylene. The method of injecting the foam core will be discussed below. Core 22 is trapezoidal in cross section with its widest portion abutting base 26. Steel edges 30 are secured to the lateral sides of base 26 in a conventional manner. Base 26 includes a polyethylene layer 27 and a base structural layer 32. Polyethylene layer 27 is typically a material sold under the trade name P-Tex. P-Tex layer 27 may also be sintered. Base structural layer 32 is preferably a thermoset composite such as fiberglass laid on top of P-Tex layer 27 of base 26 and also on top of metal edges 30. Base structural layer 32 provides the structural support for the bottom portion of ski 20. Base 26 is preferably formed as a separate element by preliminarily P-Tex layer 27 and lower structure layer 32. The composite base layer is then shaped and metal edges 30 are temporarily attached. The assembly is then placed in a mold as explained below.

Core 22 is disposed on top of base structural layer 32 of base 26. Thermoplastic composite layer 28 covers the top and sides of core 22 and is joined to edges 30. Base structural layer 32 may also be joined to thermoplastic composite layer 28. As discussed below, a chemical bond between thermoplastic composite layer 28 and core 22 is formed during construction of the ski. Outer or surface layer 24 forms the outer top and sidewalls of ski 20 by being joined to the outer surface of thermoplastic composite layer 28. Outer layer 24 preferably is formed of acrylic or urethane. Outer layer 24 functions as the cosmetic top or cap of ski 20 and bears the ski graphics as well as acting as a protective cover for the structural thermoplastic composite layer 28.

Figure 3:
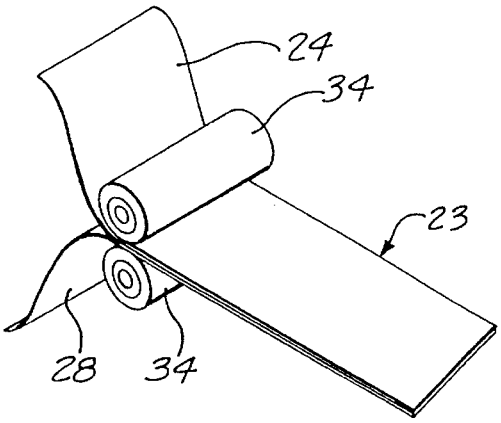
FIG. 3 is a semischematic perspective view showing the joining of a top layer to a thermoplastic composite layer.

The method of construction of the preferred embodiment of ski 20 will now be discussed with reference to FIGS. 3–7. Referring initially to FIG. 3, the formation of shell 23 is shown. A rectangular sheet of acrylic or urethane, which forms outer layer 24, and a sheet of thermoplastic composite layer 28 are provided, typically on large spools.

Thermoplastic composite layer 28 is first constructed of a thermoplastic embedded with unidirectional or multidirectional fibers, such as fiberglass, KEVLAR, carbon, or ceramic fibers. Fiberglass is the preferred fiber to be used since it is an easily obtainable and low-cost material. However, other materials may be selected to achieve specific design characteristics. KEVLAR is an aramid fiber with very high strength and low weight. It also has high tensile strength. Carbon fiber is made from graphite fibers that are heated to extreme temperatures under oriented stress. It has a very high modulus of elasticity and low weight. Ceramic fibers are monocrystalline oxide fibers processed under high temperatures and drawn through a die similar to glass fibers. They offer excellent fatigue resistance.

In a preferred embodiment, strands of fiberglass are formed into a multidirectional weave and placed within the thermoplastic to form a thermoplastic composite sheet. A solution coating process is preferably used. This process involves dissolving the thermoplastic in a solvent, impregnating the woven fiberglass fabric with the plastic/solvent solution, and forcing the solvent out. The plastic and fiberglass remain in sheet form. Other known fabrication processes may also be used such as pultrusion. The thermoplastic composite sheets are cut into rectangular patterns to form thermoplastic composite layers 28.

Outer layer 24 carries the graphics of the ski. These graphics are preferably applied to outer layer 24 before it is joined to thermoplastic composite layer 28 by an ink sublimation process applied to the underside of outer layer 24. Outer layer 24 is also cut into a matching rectangular shape prior to being joined to thermoplastic composite layer 28. As shown in FIG. 3, the two layers are joined by feeding outer layer 24 and thermoplastic composite layer 28 between rollers 34. The pressure of rollers 34 on layers 24 and 28 along with the application of heat through rollers 34 causes outer layer 24 to bond to thermoplastic composite layer 28 to form shell 23. An adhesive is not necessary between outer layer 24 and thermoplastic composite layer 28, since a chemical bond takes place between the layers as heat and pressure are applied. Alternatively, an adhesive may be used to join the layers.

Figure 4:
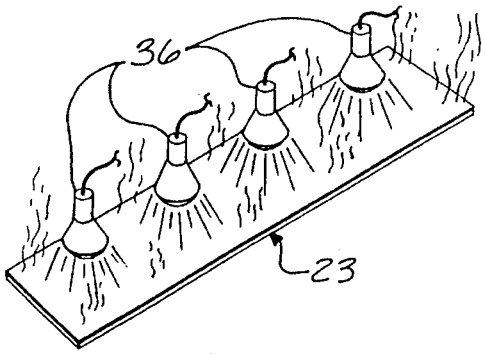
FIG. 4 is a semischematic perspective view showing the heating of the shell.

As seen in FIG. 4, shell 23 may then be heated by a heat source such as infrared lamps 36 to provide additional heat to shell 23 prior to its being molded into a top cap shape. By heating shell 23 to a temperature below its melting point, shell 23 becomes easily deformable.

Figure 5:
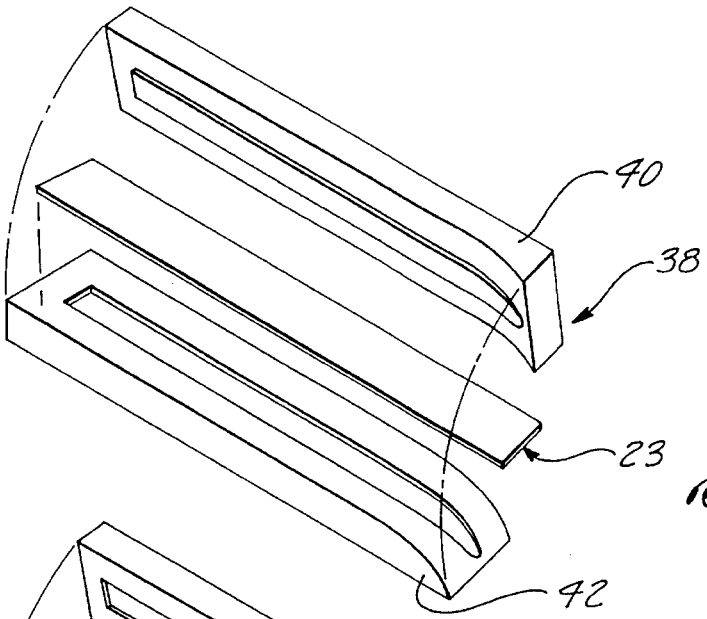
FIG. 5 is a semischematic perspective view showing the molding of the shell.

Referring now to FIG. 5, heated shell 23 is placed within a mold 38. Mold 38 includes a first forming die 40 and a cooperatively shaped second forming die 42. First forming die 40 includes a projection in the shape of the inner surface of the desired top cap shape. Second forming die 42 includes a recess having the shape of the desired outer configuration of the top cap to be formed by molding shell 23. Thus, the recessed shape within second forming die 42 is very close to the final outer shape of the top and sides of ski 20. Not only do the projection and recess of first and second forming dies 40 and 42, respectively, define the desired final thickness of the shaped shell 23, they also define the desired camber, side cut, and tip and tail curvatures. Shell 23 is placed between first and second forming dies 40 and 42 after being heated by the infrared lamps. Forming dies 40 and 42 are then pressed together for approximately 45 to 60 seconds. During this time, the dies absorb heat from shell 23 while shaping it. To accomplish the curing, the dies 40 and 42 are preferably kept at a lower temperature than shell 23. This step of the present method of ski manufacture represents an important advance over currently used methods of forming a top cap wherein a thermosetting fiberglass material is laid up within a formed outer layer 24. The prior process requires at least a ten-minute curing period before proceeding to the next step. However, with the method of the present invention, only the relatively short time of 45 to 60 seconds is required to form shell 23 into a top cap shape. A structural ski shell is thus provided that comprises a cosmetic shell with a reinforcing thermoplastic composite layer 28 joined to it. The forward shell is thus produced faster and with less chance for error. Improved bonding between layers of the shell is also achieved by the method disclosed herein.

Figure 6:
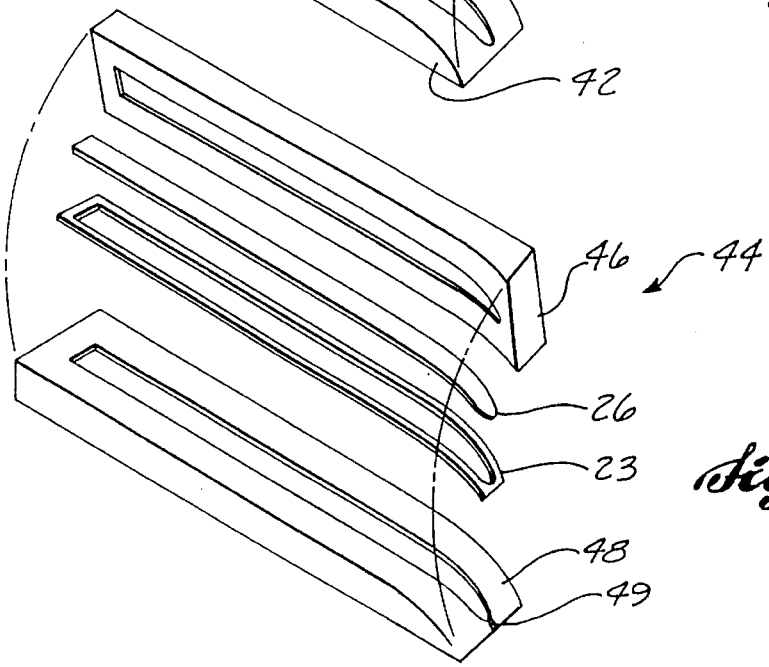
FIG. 6 is a semischematic perspective view showing the setup of the base and shell within a jig.

Referring now to FIG. 6, the formed shell 23 is then placed adjacent the base 26, constructed as described above with P-Tex layer 27, base structural layer 32, and edges 30. Shell 23 and base 26 are placed within a jig 44. Jig 44 includes a top unit 46 and a bottom unit 48 in one embodiment, both having recesses to hold and orient base 26 against shell 23. Base 26 and shell 23 form a void between them within which core 22 is formed. Jig 44 is formed to include the desired outer dimensions of the ski including camber, curvature, and side-cut. In one embodiment, jig 44 includes a channel 49, extending from the front of the recess where the ski tip is positioned, through which the foam core is injected in a known manner.

Figure 7:
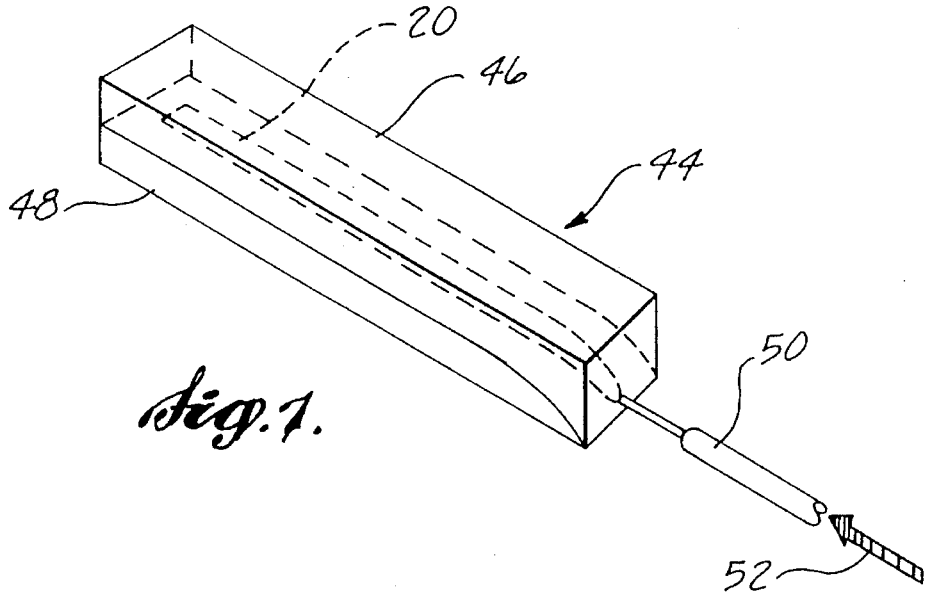
FIG. 7 is a semischematic perspective view showing injection of a foam material between the base and shell held within a jig.

Referring to FIG. 7, jig 44 is shown in a closed position with shell 23 and base 26 held between top unit 46 and bottom unit 48. An injector 50 is connected to channel 49 and foam 52 is pumped at high pressure into the space between shell 23 and base 26. The foam is preferably a thermosetting polyethylene that cures over several minutes. As the foam cures it also bonds to base 26 and to the thermoplastic composite layer 28 of shell 23. This bonding holds ski 20 together in its final form. Once the thermosetting foam 52 cures completely to form core 22, ski 20 is removed from jig 44 and the sides and edges are trimmed and finished.

As discussed above, this method provides several advantages over prior methods of manufacturing skis. The time with which a ski can be manufactured precisely and accurately is greatly reduced due to the use of thermoplastic composite layer 28. The step of molding shell 23 into a top cap shape is relatively easy, effective, and quick as compared with prior processes. Labor-intensive hand layup is not necessary. Also, the bond between core 22 and shell 23 is more easily accomplished since a primarily chemical bond is formed between these two members rather than a mechanical bond, such as that formed between a thermosetting fiberglass material and a polyethylene core. Thus, special surface preparation is avoided while still obtaining a reliable bond.

Several obvious alternatives to the above-described method may be used and are considered to be within the scope of this invention. For example, base 26 could be provided with a thermoplastic composite structural layer instead of thermosetting base structural layer 32. Also, an adhesive may be used between thermoplastic composite layer 28 and outer layer 24 to join the two together. Different fibers could be used to form the thermoplastic composite other than fiberglass. Also, single-axis or multiaxis fiber configurations could be used. The resin material of the thermoplastic composite can be formed from urethanes, acrylics, polyamides, or polycarbonates. The advantages of these materials include their mechanical strength, relatively low forming temperature, relatively low cost, and high bondability. The high surface energy of these materials helps them bond to the foam and also to the urethane or acrylic top layer. This bonding can be accomplished without physically roughing the surface of the thermoplastic composite layer before bonding, since a chemical bond takes place and not just a mechanical bond as is the case between injected foam and a thermosetting resin material.

Figure 8:
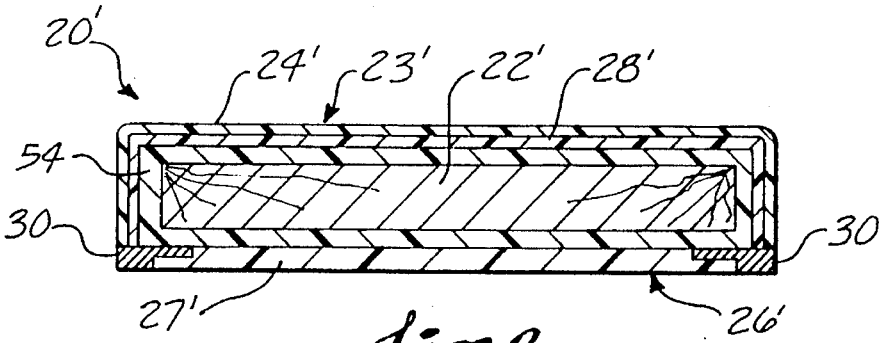
FIG. 8 is a cross-sectional elevation view showing an alternate embodiment of the invention with a reinforcing layer.
Figure 9:
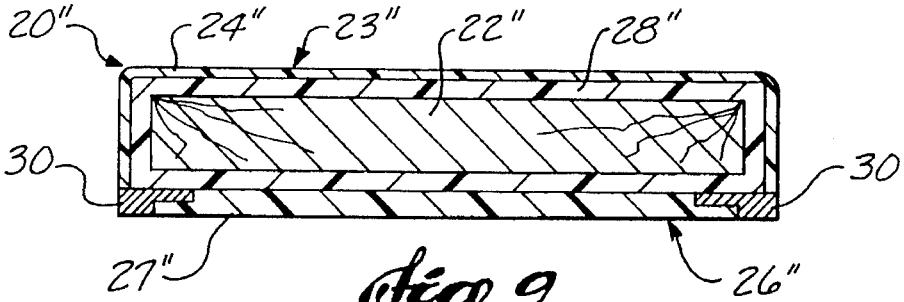
FIG. 9 is a cross-sectional elevation view of an alternate embodiment of the invention including a torsion box constructed of a thermoplastic composite.
Figure 10:
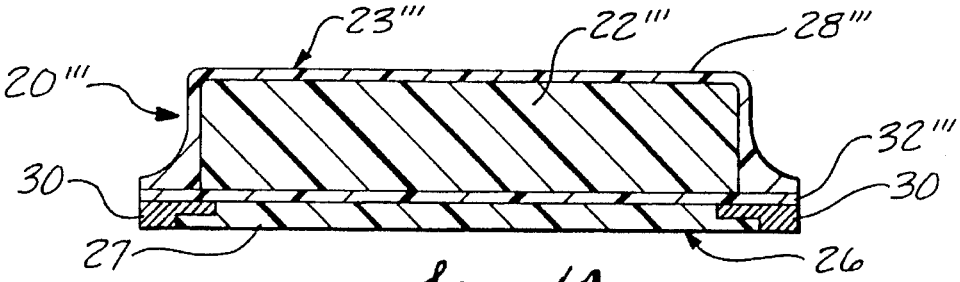
FIG. 10 is a cross-sectional elevation view of another alternate embodiment of the invention with a thermoplastic composite layer forming the top layer.

Specific alternate constructions of a ski according to the present invention are illustrated in FIGS. 8–10 and described below. In FIG. 8, a ski 20' is shown having a wood core 22'. A standard torsion box 54 is laid up around core 22' by conventional methods. Typically a fiberglass, or other composite, sock is placed around core 22' and impregnated with a thermosetting resin. A base 26' with edges 30 and a shell 23' are then joined to torsion box 54. Torsion box 54 may form the base structural layer such that a separate fiber composite layer is not necessary. However, a thermoplastic composite layer 28' may be joined to outer layer 24' before being formed and joined to torsion box 54. Thermoplastic composite layer 28' principally functions as backing to outer layer 24' to add thermostability and rigidity to outer layer 24'. If outer layer 24' is constructed of a urethane plastic, or other material, that may have less than optimum thermostability characteristics, dimples or other discontinuities may occur on the top surface or sides of ski 20' during cooling of outer layer 24'. By joining thermoplastic composite layer 28' to outer layer 24' before shell 23' is joined to torsion box 54, the thermostability and rigidity of shell 23' are greatly enhanced such that dimples and other discontinuities do not occur. Thermoplastic composite layer 28' can also add to the structural characteristics of ski 20' and can aid in easy joining of torsion box 54 to outer layer 24'.

Referring now to FIG. 9, another alternate embodiment of the present invention is provided. In this embodiment, a core 22" is provided that is preferably wood but may alternatively also be constructed of foam or other material. The key feature of this embodiment, however, is the thermoplastic composite torsion box 28" completely surrounding core 22". Thermoplastic composite torsion box 28" may be placed around core 22" by heating a sheet of thermoplastic composite material and wrapping it around core 22'. A polyethylene base 26" and edges 30 are provided and an outer layer 24' surrounds the top and sides of thermoplastic composite torsion box 28".

FIG. 10 illustrates still another embodiment of the present invention. In this embodiment, base 26 described above and illustrated in FIG. 2 is provided with base structural layer 32''' and edges 30 connected to P-Tex layer 27. A core formed of wood or a foam material is disposed above base structural layer 32'''. However, in this embodiment, entire shell 23''' is made up of thermoplastic composite layer 28''' without a separate outer layer. Thus, thermoplastic composite layer 28''' forms the structural as well as outer aesthetic functions and protection of ski 20'''.

While the preferred embodiments of the invention have been illustrated and described, it will be appreciated that various changes can be made therein without departing from the spirit and scope of the invention. For example, as mentioned above, the runner of the present invention may comprise a snowboard or other device for gliding over snow. The method and construction may then vary slightly in some particulars while still falling within the scope of the invention claimed herein.

The embodiments of the invention in which an exclusive property or privilege is claimed are defined as follows:

1. A method of manufacturing a runner having a base and a core covered with a shell, the shell including an outer layer, the method comprising the steps of:

(a) providing a thermoplastic composite layer comprised of fibers disposed within a thermoplastic resin;

(b) joining the thermoplastic composite layer to the outer layer;

(c) molding the shell, including the outer layer and the thermoplastic composite layer, into a cap to cover the top and sides of the ski, said molding being accomplished by placing the joined thermoplastic composite layer and the outer layer in a cap mold, compressing the joined layers into a cap and removing the cap from the cap mold; and (d) joining the shell to the base and the core after the shell has been removed from the cap mold.

2. The method of claim 1, wherein the thermoplastic composite layer includes fibers extending within the thermoplastic resin in a plurality of directions.

3. The method of claim 2, wherein the thermoplastic composite includes fibers woven together.

4. The method of claim 1, further including the step of heating the shell, including the outer layer and the thermoplastic composite layer before said step of molding the shell.

5. The method of claim 4, wherein said step of molding the shell is accomplished by pressing the shell into a cap configuration with forming dies, the dies absorbing at least a portion of the heat from said step of heating the shell.

6. The method of claim 5, wherein said step of heating the shell includes placing the shell adjacent at least one infrared lamp.

7. The method of claim 5, further including the steps of:

providing a base having a bottom surface, a top surface, and lateral sides, the lateral sides having edges extending along at least a portion of the length of the base; inserting a core between the base and the shell after the shell has been formed into a cap; and joining the base and the shell together around the core.

8. The method of claim 7, wherein the thermoplastic composite includes fibers extending within the thermoplastic resin in a plurality of directions.

9. The method of claim 1, wherein the step of joining the thermoplastic composite layer to the outer layer comprises applying heat to the layers and pressing them together while the layers are flat before molding the layers into a cap.

10. A method of manufacturing a runner having a base and a core covered with a shell, the shell including an outer layer, the method comprising the steps of:

(a) providing a thermoplastic composite layer comprised of fibers disposed within a thermoplastic resin;

(b) joining the thermoplastic composite layer to the outer layer;

(c) heating the shell, including the outer layer and the thermoplastic composite layer;

(d) molding the shell, including the outer layer and the thermoplastic composite layer, into a cap to cover the top and sides of the ski, wherein said step of molding the shell is accomplished by pressing the shell into a cap configuration with forming dies, the dies absorbing at least a portion of the heat from said step of heating the shell;

(e) providing a torsion box disposed around the core;

(f) providing a base having a bottom surface, a top surface, and lateral sides, the lateral sides having edges extending along at least a portion of the length of the base;

(g) inserting the core and the torsion box between the base and the shell; and (h) joining the shell to the base and the core.

11. The method of claim 10, wherein the torsion box comprises a thermoplastic composite.

12. A method of manufacturing a runner having a base and a core covered with a shell, the shell including an outer layer, the method comprising the steps of:

(a) providing a thermoplastic composite layer comprised of fibers disposed within a thermoplastic resin;

(b) joining the thermoplastic composite layer to the outer layer;

(c) heating the shell, including the outer layer and the thermoplastic composite layer wherein said step of molding the shell is accomplished by pressing the shell into a cap configuration with forming dies, the dies absorbing at least a portion of the heat from said step of heating the shell;

(d) molding the shell after heating, including the outer layer and the thermoplastic composite layer, into a cap to cover the top and sides of the ski;

(e) providing a base having a bottom surface, a top surface, and lateral sides, the lateral sides having edges extending along at least a portion of the length of the base;

(f) inserting a core between the base and the shell; and (g) joining the base and the shell together around the core, wherein said steps of inserting a core and joining the base and the shell comprise the steps of positioning the base adjacent the shell, after being molded, into a jig, the thermoplastic composite layer of the shell facing the base, the shell and the base forming the outer shape of the ski and having a void between the base and the shell; and injecting foam between the base and the shell into the void, the foam joining the base to the shell.

13. The method of claim 12, further comprising the step of joining a composite reinforcing layer to the top surface of the base along at least a portion of the length of the base before said step of positioning the base adjacent the shell.

14. The method of claim 13, wherein said step of joining a composite reinforcing layer to the top surface of the base comprises joining a thermoplastic composite to the top surface of the base.

15. The method of claim 14, wherein said step of joining a thermoplastic composite to the top surface of the base comprises applying heat to the thermoplastic composite and pressing the thermoplastic composite to the top surface.

16. A method of manufacturing a runner having a base and a core covered with a shell, the shell including an outer layer, the method comprising the steps of:

(a) providing a thermoplastic composite layer comprised of fibers disposed within a thermoplastic resin;

(b) joining the thermoplastic composite layer to the outer layer;

(c) heating the shell, including the outer layer and the thermoplastic composite layer, wherein said step of molding the shell is accomplished by pressing the shell into a cap configuration with forming dies, the dies absorbing at least a portion of the heat from said step of heating the shell;

(d) molding the shell after heating, including the outer layer and the thermoplastic composite layer, into a cap to cover the top and sides of the ski;

(e) providing a base having a bottom surface, a top surface, and lateral sides, the lateral sides having edges extending along at least a portion of the length of the base;

(f) inserting a core between the base and the shell; and (g) joining the base and the shell together around the core, wherein the thermoplastic composite includes fibers woven together and extending within the thermoplastic resin in a plurality of directions.

17. A method of manufacturing a runner having a base and a core covered with a shell, the shell including an outer layer, the method comprising the steps of:

(a) providing a thermoplastic composite layer comprised of fibers disposed within a thermoplastic resin;

(b) joining the thermoplastic composite layer to the outer layer to increase the thermal stability of the shell;

(c) joining a structural layer to the core on at least the top of the core; and (d) joining the thermoplastic composite layer and outer layer to the structural layer and the core after the structural layer is disposed on the core and after the thermoplastic composite layer and outer layer are joined together, wherein the theromoplastic composite and outer layers cover the top and sides of the runner.

* * * * *